United States Patent [19]

Hasegawa

[11] 4,205,760

[45] Jun. 3, 1980

[54] NON-DETACH BEVERAGE END

[75] Inventor: Gary K. Hasegawa, Chicago, Ill.

[73] Assignee: The Continental Group, Inc., New York, N.Y.

[21] Appl. No.: 11,730

[22] Filed: Feb. 12, 1979

[51] Int. Cl.[2] ..... B65D 41/32

[52] U.S. Cl. ..... 220/271

[58] Field of Search ..... 220/268–273

[56] References Cited

U.S. PATENT DOCUMENTS

| | | | |
|---|---|---|---|
| 3,499,573 | 3/1970 | Adams | 220/271 |
| 3,910,454 | 10/1975 | Novak | 220/271 |
| 4,105,134 | 8/1978 | Debenham et al. | 220/271 |

*Primary Examiner*—George T. Hall

*Attorney, Agent, or Firm*—Charles E. Brown

[57] ABSTRACT

An easy opening container wherein the opening panel is pushed into the interior of the container and wherein, in addition to the opening panel, the single line of weakness also defines a vent panel. The container is provided with an opening tab having a nose divided into first and second nose portions with the first nose portion being operable upon tilting of the opening tab to push in the vent panel to form a vent opening followed by the sequential operation of the second nose portion to push in the opening panel. The second nose portion is interlocked with the container in its fully opened position so that when the opening tab is returned to its initial position only the relatively small and short first nose portion projects into the dispensing opening.

22 Claims, 7 Drawing Figures

FIG.5
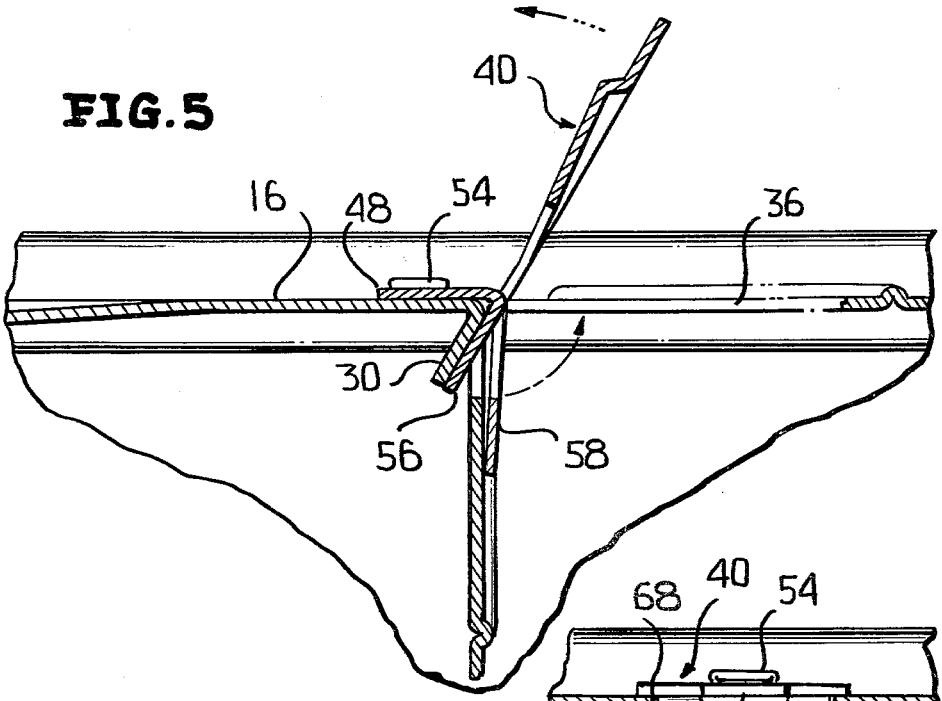
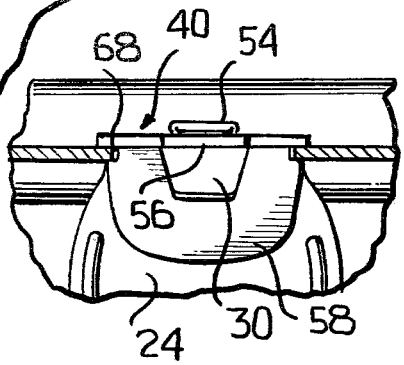
FIG.7
FIG.6
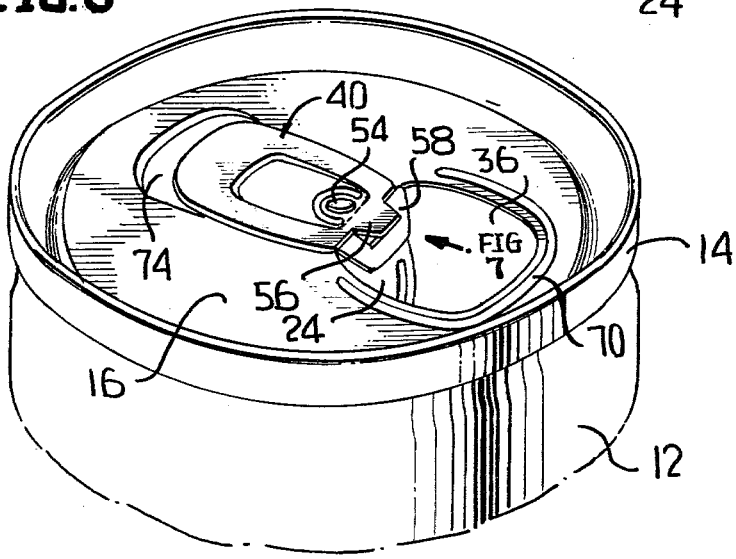

NON-DETACH BEVERAGE END

This invention relates in general to new and useful improvements in easy opening containers, and more particularly to a novel opening tab and weakening line arrangement.

When a product is packaged under pressure, particularly a beverage, during the initial part of the opening process of the container rapid venting occurs, with the result that there is a spraying of the product. This invention relates to the provision of a vent opening in an easy opening container of the type wherein the dispensing opening defining panel portion is pushed into the interior of the container and wherein the opening tab remains attached to the container after the opening process.

A primary feature of the invention is the formation of a single line of weakness, normally a score line, in the container panel with that single line of weakness defining both a vent opening defining panel portion and a dispensing opening defining panel portion. Most specifically, the vent opening defining panel portion projects into the dispensing opening defining panel portion and is so positioned whereby upon the initial lifting of an associated opening tab, it is first displaced out of the general plane of the container panel and serves to vent the interior of the container under controlled conditions with a minimum of spraying.

With the weakening line configuration of this invention, after the vent opening has been formed, further actuation of the opening tab results in the dispensing opening being formed, and when the dispensing opening is finally formed, the vent opening becomes part of the dispensing opening.

Another feature of the single line of weakness is that both the vent opening defining panel portion and the dispensing opening defining panel portion are hingedly connected to the adjacent part of the container panel along a transverse line with these transverse lines being in longitudinal alignment and continuations of one another so that there is but a single hinge line for the entire unit.

Another feature of the invention is the provision of a novel opening tab which includes a nose carried by a body and wherein the nose includes first and second nose portions. The first nose portion is rigid with the body and is operable initially to effect the formation of the vent opening. The second nose portion is hingedly connected to the body for limited pivoting of the body relative to the second nose portion whereby the first nose portion may be operated to effect the formation of the vent opening, after which further tilting of the opening tab relative to the container panel will result in the second nose portion becoming rigid with the tab body and being operative to effect the formation of the dispensing opening.

The first nose portion projects into the second nose portion, and thus the first nose portion may be formed without requiring any additional metal over and above that required for the normal formation of a like opening tab without the separate nose portion.

The second nose portion, in addition to being hingedly carried by the body, is so related to the body wherein, after a limited hinging of the body relative to the second nose portion, abutment surfaces on the body and second nose portion engage and form a rigid connection between the body and second nose portion in the opening direction of movement of the tab.

Yet another feature of the opening tab is that the second nose portion is of a configuration wherein when the tab is moved to a full container opening position, the second nose portion becomes interlocked beneath the container panel and is locked in an out-of-the-way position so that it does not return with the opening tab when it is reversely pivoted back towards its initial position overlying and substantially parallel to the container panel.

With the above and other objects in view that will hereinafter appear, the nature of the invention will be more clearly understood by reference to the following detailed description, the appended claims, and the several views illustrated in the accompanying drawings.

IN THE DRAWINGS

FIG. 5 is a sectional view similar to FIG. 4, and shows the opening tab tilted to full opened position.

FIG. 6 is a top perspective view similar to FIG. 1, and shows the end unit in an opened condition ready for the dispensing of a product, the opening tab having been tilted back substantially to its initial position.

FIG. 7 is an enlarged fragmentary sectional view taken generally along the line 7—7 of FIG. 6, and shows one of the nose portions in its interlocked position where it is retained after the full opening of the container and the tab is tilted back towards its initial position.

Figure 1:
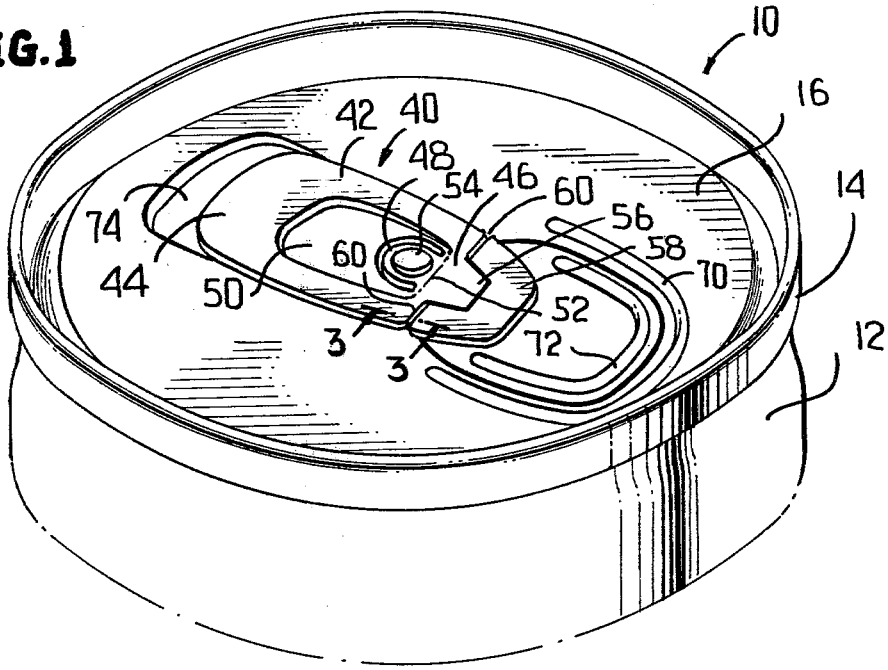
FIG. 1 is a top perspective view of an end unit of a can incorporating the weakening line configuration and opening tab, the end unit being shown attached to a conventional can.

Referring now to the drawings in detail, it will be seen that there is illustrated in FIG. 1 an easy opening end unit formed in accordance with this invention. The end unit is generally identified by the numeral 10, and is secured to a conventional can body 12 by means of a conventional double seam 14. The structural details of the end unit 10 and its connection to the container body is not part of this invention, and the end unit will not be described in further detail except to indicate that it does include an end panel 16.

The end panel 16 is provided with a single line of weakness 18 which defines panel portions for displacement from the general plane of the end panel 16 to form both a vent opening and a dispensing opening. It will be seen that the line of weakness is preferably in the form of a score line. The line of weakness 18 is generally of a configuration in accordance with the desired dispensing opening configuration, and includes a pair of spaced apart terminal ends 20, 22. The score line 18 defines a panel portion 24 which, when bent relative to the end panel 16 about a hinge line 26 extending between the score line ends 20, 22, defines a dispensing opening.

The score line 18, adjacent the terminal end 22, is of a generally U-shaped outline as at 28. This U-shaped outline portion 28 generally projects into the interior of the score line configuration and defines a displaceable panel portion 30 which, in effect, projects into the panel portion 24. The panel portion 30 is separately displaceable relative to the end panel 16 along a hinge line 32 which is longitudinally aligned with and is, in effect, a continuation of the hinge line 26.

Figure 4:
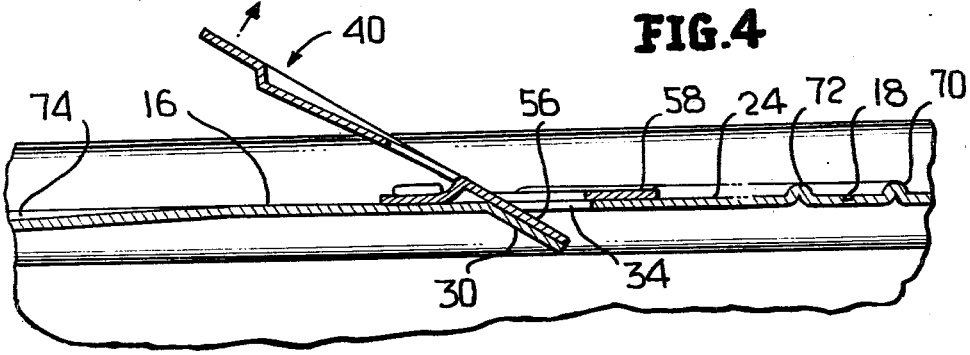
FIG. 4 is an enlarged fragmentary sectional view taken through the end unit after the opening tab has been partially tilted relative to the end panel, and shows the formation of the vent opening.

It is to be understood that in accordance with this invention, pressure is first to be exerted on the panel portion 30 with the score line portion 28 initially rupturing the panel portion 30 being displaced into the interior of the can to form a vent opening. After an initial venting of the can, pressure is applied on the panel portion 24 to complete the rupture of the end panel along the score line 18 with the panel portion 24 hinging along the hinge line 26 as it is pushed into the interior of the can. While the panel portion 30 will be displaced through a greater arc than the displacement of the panel portion 24, it will be seen that the vent opening formed by the inward displacement of the panel portion 30 actually becomes part of the dispensing opening which is formed when the panel portion 24 is displaced into the interior of the can to a full opened position, as is shown in FIG. 4. The vent opening is identified by the numeral 34 and is best shown in FIG. 4. The dispensing opening is identified by the numeral 36 and is best shown in FIG. 6.

In order to effect the sequential formation of the vent opening 34 and the dispensing opening 36, there is provided a special opening tab formed in accordance with this invention, the opening tab being generally identified by the numeral 40. The opening tab is suitably formed from sheet metal or like material and includes a body 42 which is of a generally U-shaped raised outline and includes a ligting portion 44 at one end. The U-shaped outline of the body 42 is completed at the end thereof remote from the lifting portion 44 in a transverse bar 46. The bar 46 carries a mounting ear 48 which extends back into the U-shaped outline portion of the body 42 into a recessed area 50 defined by the U-shaped body configuration. The mounting ear 48 is hingedly connected to the bar along a transverse hinge line 52. The mounting ear is fixedly secured to the end panel 16 by a rivet 54 which is integrally formed with the end panel.

The pull tab 40 further includes a nose carried by the body 42. The nose includes a first nose portion 56 which is rigid with the bar 46 and thus rigid with the body 42. The nose also includes a second nose portion 58 which is generally U-shaped in outline and which has the first nose portion 56 projecting thereinto. The second nose portion 58 is connected to the bar 46 of the body 42 along two hinge lines which are separated by the nose portion 56.

Figure 3:
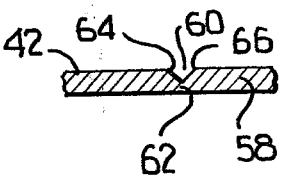
FIG. 3 is an enlarged fragmentary sectional view taken generally along the line 3—3 of FIG. 1, and shows specifically the hinge connection between a nose portion and the body of the opening tab which permits the body to be pivoted without moving the nose portion during an initial part of an opening operation.

As is best shown in FIG. 3, each hinge portion is of a configuration wherein the nose portion 58 is connected to the body 42 by a lowermost connecting strap portion 62. Above the connecting strap portion 62 the body 42 has an abutment surface 64 which generally opposes but is spaced from an abutment surface 66 on the nose portion 58.

The strength of the connecting strap 62 is such that during an opening operation, when the tab body 42 is tilted upwardly away from the end panel 16, as shown in FIG. 4, the nose portion 58 will engage the panel portion 24, but the connecting strap portion 62 will not have sufficient strength to resist bending of the opening tab 40 along the hinge lines 60. Thus the nose portion 56 may be pivoted to exert an opening force on the panel portion 30 to effect the rupture of the score line portion 28 and the bending thereof along the hinge line 32 to form the vent opening 34, as shown in FIG. 4.

When the opening tab 40 has been tilted relative to the end panel 16 to the position shown in FIG. 4, the abutment surfaces 64, 66 come into engagement with one another and the nose portion 58 becomes rigid with the tab body 42. Thus, further tilting of the tab body away from the end panel will result in the nose portion 58 exerting an opening pressure on the panel portion 24 and the rupture of the end panel along the remainder of the score line 18 followed by the inward displacement of the panel portion 24 to form the dispensing opening 36, as is best shown in FIG. 5.

Figure 2:
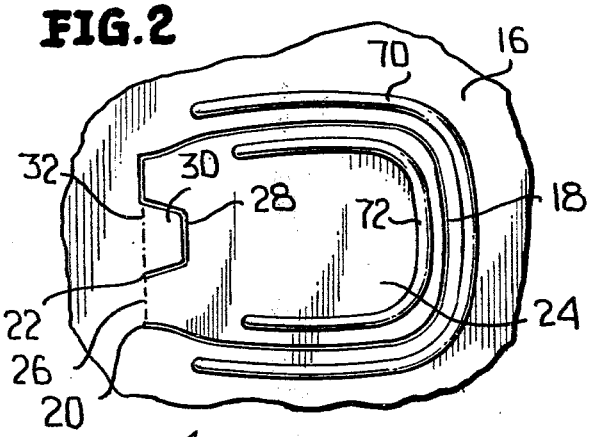
FIG. 2 is an enlarged fragmentary plan view of the end panel of the end unit, and shows the specific configuration of the line of weakness formed in the end panel in accordance with this invention.

Referring back to FIG. 2, it will be seen that adjacent its initial connection to the end panel 16, the panel portion 24 is of a reduced width. Thus, the nose portion 58 may be of a greater width than the width of the dispensing opening 36 immediately adjacent that portion of the end panel 16 to which the panel portion 24 is hingedly connected. At the same time, the configuration of the panel portion 58 adjacent the hinge line 60 may be one which includes slight notches 68 as shown in FIG. 7. When the panel portion 58 is displaced to a vertical position, the notches permit the panel portion 58 to interlock beneath the end panel 16 on opposite sides of the dispensing opening 36. Thus, the panel portion 58 becomes interlocked with the end panel when the panel portion 58 is projecting substantially normal to the end panel 16 into the interior of the can. With the panel portion 58 so interlocked with the end panel, when the opening tab 40 is reversely tilted substantially back to its original porition, the panel portion 58 remains stationary and the tab body 40 hinges relative to the panel portion 58 along the hinge lines 60. Thus, in the fully opened position of the container, as shown in FIG. 6, only the relatively small and relatively short nose portion 56 projects into the dispensing opening 36, thereby minimizing the interference of the opening tab with the dispensing process.

If desired, the end panel 16 may be provided with a suitable reinforcing bead 70 generally surrounding the panel portion 24. The panel portion 24 may be also provided with a suitable reinforcing rib 72.

Further, in order to facilitate the initial lifting of the opening tab 40 at the lifting end thereof, the end panel 16 may be inwardly recessed as at 74 to permit one to engage one's finger beneath the lifting portion 44 to initiate the tilting of the opening tab 40 relative to the end panel 16.

Although only a preferred embodiment of the line of weakness configuration and the opening tab has been specifically illustrated and described herein, it is to be understood that minor variations may be made in both the score line configuration and the opening tab construction without departing from the spirit and scope of the invention as defined by the appended claims.

I claim:

1. An easy opening container arrangement comprising a container panel, and a single line of weakness in said container panel outlining a vent opening defining panel portion and a separate dispensing opening defining panel portion, each panel portion having a separate line of hinging with the remainder of said container panel, said lines of hinging being aligned longitudinally of said lines of hinging.

2. The container arrangement of claim 1 wherein said lines of hinging are a continuation of one another.

3. An easy opening container arrangement comprising a container panel, and a single line of weakness in said container panel outlining a vent opening defining panel portion and a separate dispensing opening defining panel portion, an opening tab secured to said container panel adjacent to but spaced from said opening defining panel portions, said opening tab having pressure applying means for first displacing said vent opening defining panel portion and then displacing said dispensing opening defining panel portion when said opening tab is tilted relative to said container panel.

4. The container assembly of claim 3 wherein said pressure applying means includes first and second nose portions.

5. The container assembly of claim 4 wherein said tab includes a body, said first nose portion is rigid with said tab body, and said second nose portion has a hinge connection with said body.

6. The container assembly of claim 4 wherein said tab includes a body, said first nose portion is rigid with said tab body, and said second nose portion has a hinge connection with said body, said hinge connection being in part on opposite sides of said first nose portion.

7. The container assembly of claim 4 wherein said tab includes a body, said first nose portion is rigid with said tab body, and said second nose portion has a hinge connection with said body, and said first nose portion projects into said second nose portion.

8. The container assembly of claim 4 wherein said tab includes a body, said first nose portion is rigid with said tab body, and said second nose portion has a hinge connection with said body, said hinge connection including abutment means on said first and second nose portions for limiting hinging of said body away from said container panel towards said second nose portion relative to said body.

9. The container assembly of claim 4 wherein said second nose portion has separate means for interlocking engagement beneath said container panel when said second nose portion is in a full dispensing opening forming position and when said body is tilted back toward said container panel.

10. An opening tab for an easy opening container panel of the type having displaceable panel portions, said tab including a body having projecting from one end thereof a nose, said nose including separately and sequentially operable first and second nose portions, and said body having connecting means for directly connecting said body to the container panel.

11. The opening tab of claim 10 wherein said first nose portion is rigid with said body and said second nose portion has a hinge connection with said body.

12. The opening tab of claim 10 wherein said first nose portion is rigid with said body and said second nose portion has a hinge connection with said body, said hinge connection being in part on opposite sides of said first nose portion 13. The opening tab of claim 10 wherein said first nose portion is rigid with said body and said second nose portion has a hinge connection with said body, and said first nose portion projects into said second nose portion.

14. The opening tab of claim 10 wherein said first nose portion is rigid with said body and said second nose portion has a hinge connection with said body, said hinge connection including abutment means on said first and second nose portions for limiting hinging of said body away from said container panel towards said second nose portion relative to said body.

15. The opening tab of claim 10 wherein said first nose portion projects into said second nose portion.

16. The opening tab of claim 10 wherein said first nose portion projects into said second nose portion and is connected to said body along a transverse line common with a line of connection between said second nose portion and said body.

17. The opening tab of claim 10 wherein said connecting means includes a mounting ear formed from and hingedly connected to said body.

18. The container assembly of claim 5 wherein the connection between said opening tab and said container panel is between said body and said container panel.

19. The container assembly of claim 6 wherein the connection between said opening tab and said container panel is between said body and said container panel.

20. The container assembly of claim 7 wherein the connection between said opening tab and said container panel is between said body and said container panel.

21. The container assembly of claim 8 wherein the connection between said opening tab and said container panel is between said body and said container panel.

22. The container assembly of claim 18 wherein the connection between said body and said container panel includes a mounting ear formed from and hingedly connected to said body.

* * * * *